US006755750B1

(12) United States Patent
Schulte et al.

(10) Patent No.: US 6,755,750 B1
(45) Date of Patent: Jun. 29, 2004

(54) TALC DISPENSER FOR CUE STICK

(76) Inventors: Michael K. Schulte, 28721 Northline, Romulus, MI (US) 48174; William A. Dailey, 22401 David, Taylor, MI (US) 48180; James C. Binelli, 5125 Rockwood Dr., Grand Blanc, MI (US) 48439

( * ) Notice: Subject to any disclaimer, the term of this patent is extended or adjusted under 35 U.S.C. 154(b) by 0 days.

(21) Appl. No.: 10/372,029

(22) Filed: Feb. 21, 2003

Related U.S. Application Data

(63) Continuation-in-part of application No. 10/289,159, filed on Nov. 6, 2002, now abandoned.

(51) Int. Cl.[7] ..... A63D 15/00; A63D 15/08

(52) U.S. Cl. ..... 473/37; 473/1; 401/9; 401/11; 222/367

(58) Field of Search ..... 473/35–39, 1, 473/2, 5; 222/367, 368; 401/9, 11

(56) References Cited

U.S. PATENT DOCUMENTS

| | | | | | |
|---|---|---|---|---|---|
| 561,659 | A | * | 6/1896 | Currier | 473/36 |
| 1,334,724 | A | * | 3/1920 | Tyler | 473/38 |
| 3,843,120 | A | * | 10/1974 | Ricci | 473/2 |
| 3,963,237 | A | * | 6/1976 | Bushberger | 473/37 |
| 4,914,832 | A | * | 4/1990 | Cuthbert | 34/354 |
| 4,934,066 | A | * | 6/1990 | Rose | 34/333 |
| 4,953,999 | A | * | 9/1990 | Rivers | 401/9 |
| 5,094,557 | A | * | 3/1992 | Nelson et al. | 401/11 |
| 5,228,160 | A | * | 7/1993 | Porper | 7/158 |
| 5,269,615 | A | * | 12/1993 | Lewis, Jr. | 401/9 |
| 5,409,536 | A | * | 4/1995 | Dimler | 118/264 |
| 5,545,093 | A | * | 8/1996 | Contestabile et al. | 473/36 |
| 5,641,232 | A | * | 6/1997 | Frey | 401/11 |
| 6,616,540 | B2 | * | 9/2003 | Slacum | 473/36 |

FOREIGN PATENT DOCUMENTS

CA 2411263 A1 * 5/2003 ..... A63D/15/08

* cited by examiner

*Primary Examiner*—Stephen P. Garbe
*Assistant Examiner*—Mitra Aryanpour
(74) *Attorney, Agent, or Firm*—John R. Benefiel

(57) ABSTRACT

A talc dispenser for cue sticks in which a housing having a talc storage cavity is formed with a through tubular passageway configured to allow insertion of a cue stick shaft. A metering element is movable to cause talc to pass out of said storage cavity and into the enclosed space to thereafter be deposited on an inserted cue stick by rubbing contact with a tube of bristle material rolled up within the through passage and on which the talc is distributed. A chalk block holder is received in a housing recess and a housing holder has a belt clip for convenient storage of the dispenser.

13 Claims, 3 Drawing Sheets

TALC DISPENSER FOR CUE STICK

CROSS REFERENCE TO RELATED APPLICATION

This application is a continuation-in-part of application 10/289,159, filed Nov. 6, 2002 now abandoned.

BACKGROUND OF THE INVENTION

This invention concerns dispensing talcum powder or talc onto a cue stick, used to minimize friction when stroking the cue stick during execution of a shot. Simple shakers are usually used, which are very messy since the talc is not dispensed just onto the cue stick but is scattered around. Also, the shakers are usually placed upright on a table or shelf when not in use, and are often inadvertently tipped over to spill the talc.

It is an object of the present invention to provide a talc dispenser which is able to deposit talc directly onto the cue stick shaft with a minimum of spillage.

It is a further object to provide such a dispenser which is convenient to use and to store when not in use, and which prevents talc spillage even when not in use.

SUMMARY OF THE INVENTION

These objects and others which will become apparent upon a reading of the following specification and claims are achieved by a dispenser including a two section housing formed with a tubular passageway extending therethrough, sized to receive the shaft of a cue stick inserted therein. A talc storage cavity in the housing is able to be filled with talc through a capped port. The through passageway is lined with a rolled up tube of soft bristle or fibrous material, with an enclosed space defined between the backing mat and the housing passageway which has a perforated backing mat. The perforated mat allows talc dispensed into the enclosed space around the outside of the backing mat to pass through the mat and be dispersed into the bristles and then directly deposited onto the cue stick shaft inserted in the tubular passageway which rubs against the bristles. Small quantities of talc are selectively dispensed into the enclosed space to be subsequently deposited onto the cue stick shaft.

Dispensing of small quantities of talc into the enclosed space may be selectively carried out by turning of a rotational metering rod received in the housing having one end which extends into a metering passage extending between the storage chamber and the tubular closed space. The metering rod end normally blocks talc from passing out of the storage chamber, but has a pair of oppositely located flats there aligned with the passage. The rod can be manually rotated by an opposite exposed end protruding out of the housing to cause a small amount of talc to fall into a small clearance space above a flat, and then be captured and carried around as the rod is rotated to be dumped into the tubular enclosed space surrounding the bristle tube mat. The talc can be distributed along the enclosed space by shaking the dispenser, and passes through the backing mat perforations to be dispersed into the bristles and thereafter directly deposited onto a cue stick shaft.

The through passageway can advantageously have a series of lengthwise ribs which engage the outside of the bristle material tubes to create the enclosed space between the housing and the outside of the bristle material tube.

Two mating housing sections are fit together with a stepped perimeter and secured with screws.

The housing also has a recess in which a chalk holder is received, holding a chalk block, with a scuff pad also mounted on the housing.

The housing is itself held in a holder which has a belt clip to be conveniently held on the user's belt.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
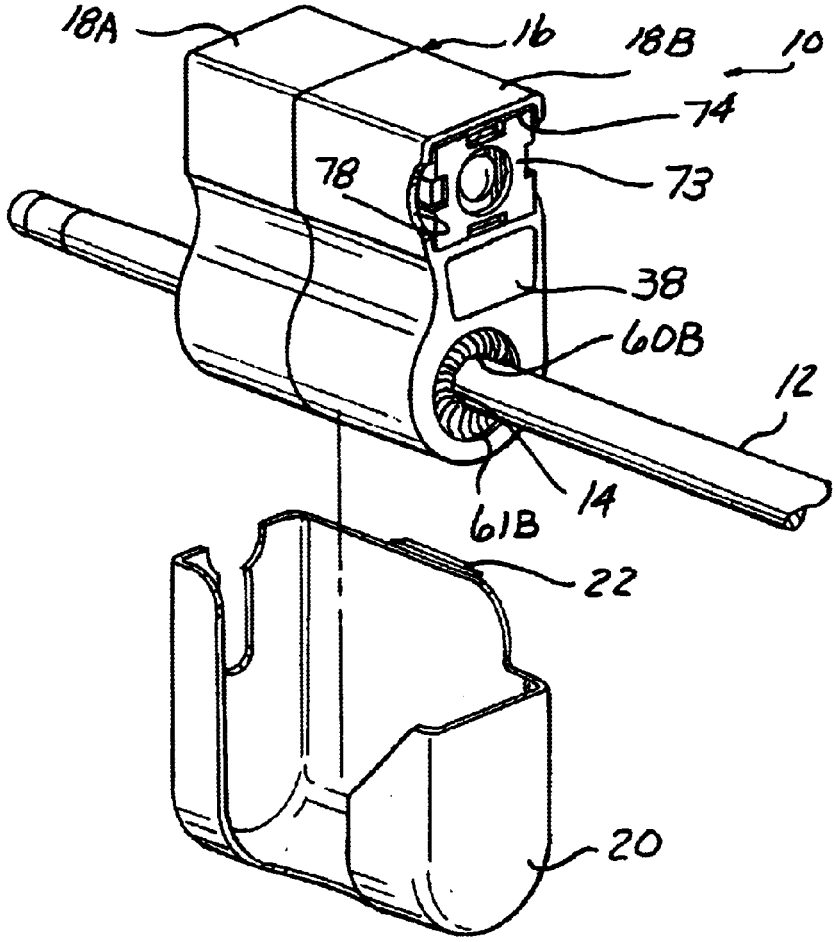
FIG. 1 is a perspective exploded view of the talc dispenser and holder according to the invention, the dispenser shown with a cue stick shaft inserted therein.
Figure 4:
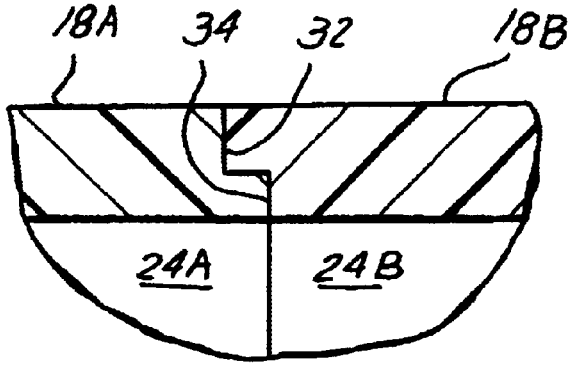
FIG. 4 is an enlarged fragmentary view of mated portions of housing sections shown in FIG. 3.
Figure 2:
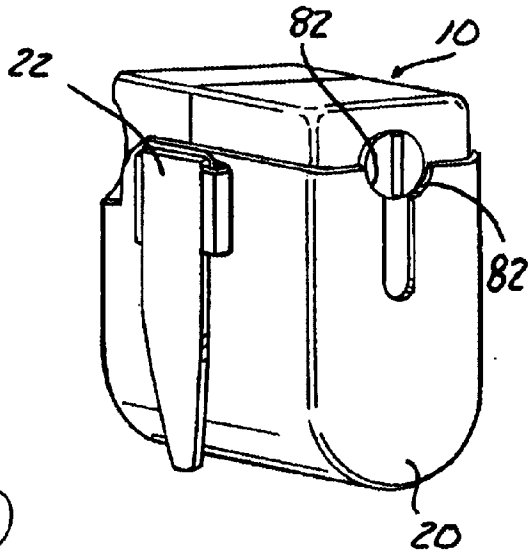
FIG. 2 is a reverse perspective view of the talc dispenser and holder shown in FIG. 1.
Figure 3:
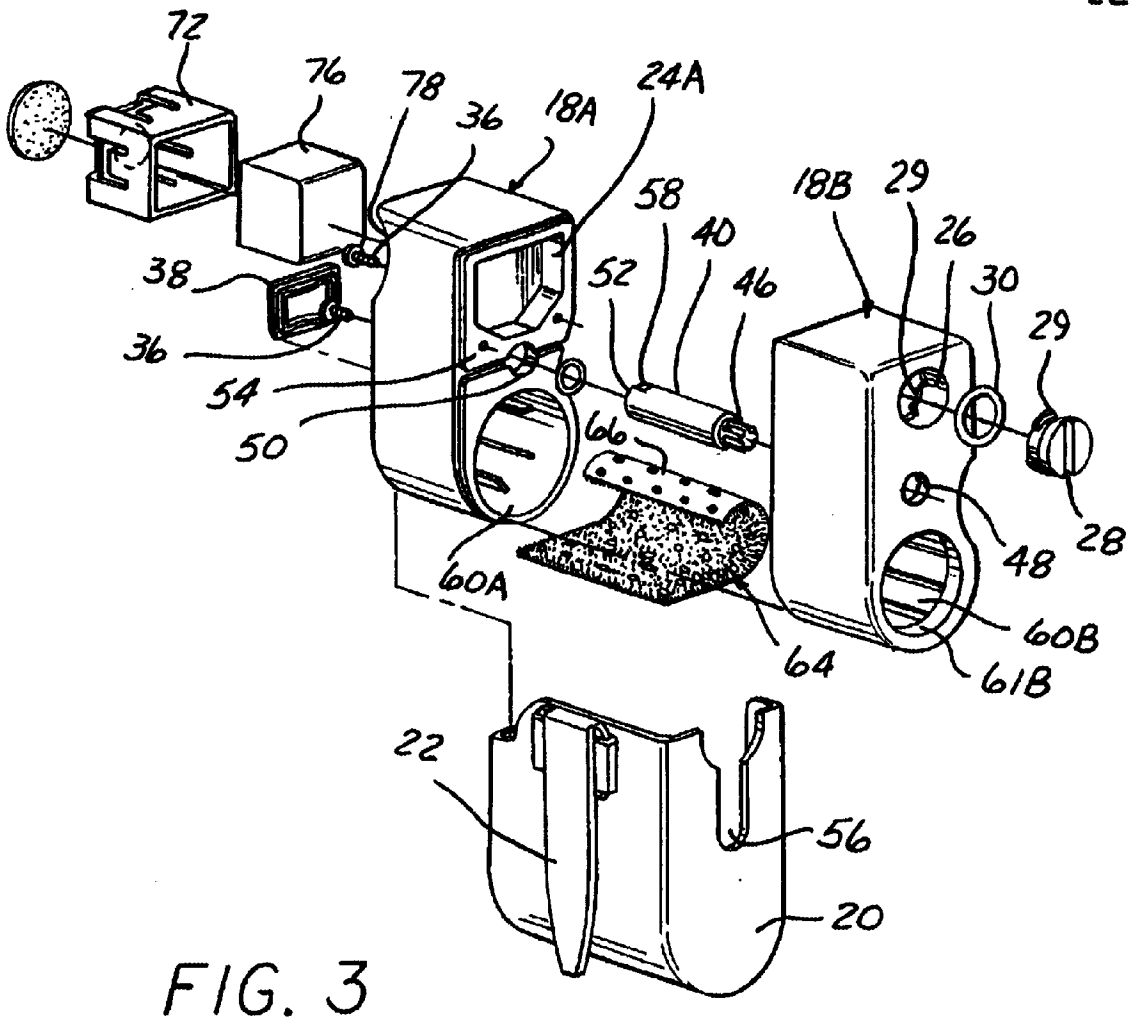
FIG. 3 is an exploded reverse perspective view of the talc dispenser shown in FIGS. 1 and 2.
Figure 5:
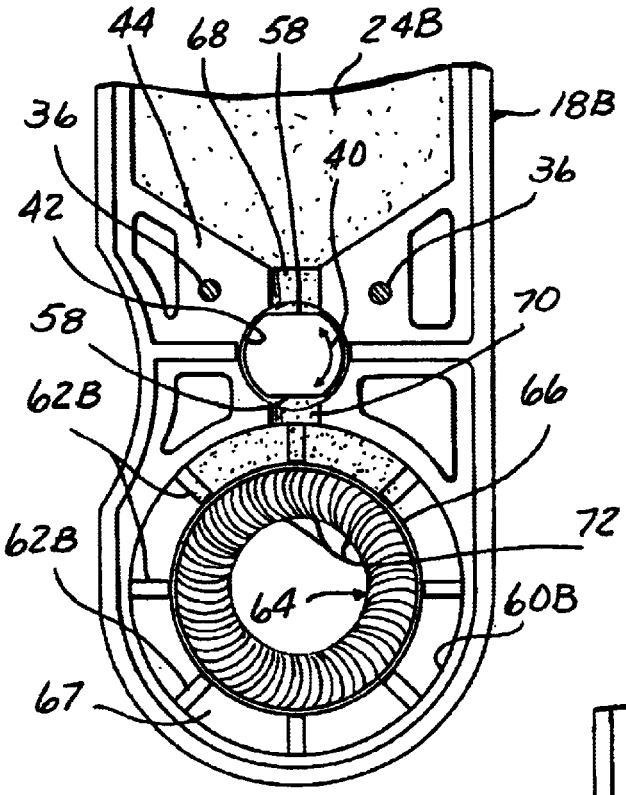
FIG. 5 is an enlarged end view of one of the housing sections of the dispenser with certain internal components held therein.
Figure 7:
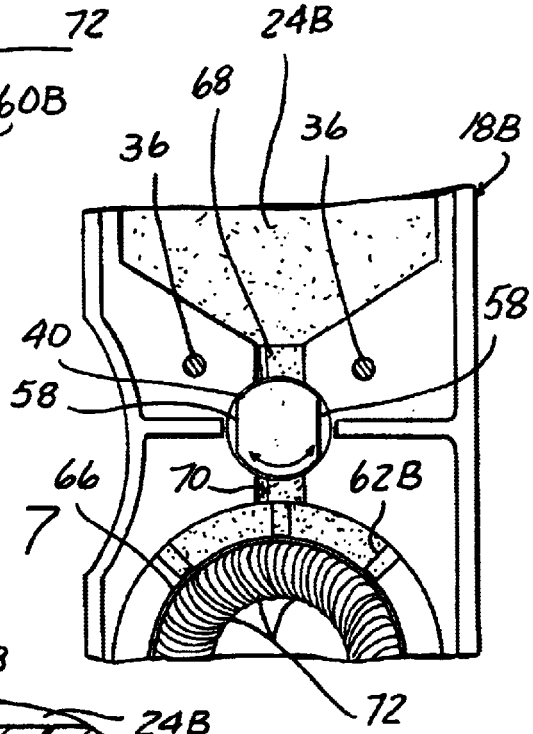
FIG. 7 is a further enlarged fragmentary end view of the housing section shown in FIG. 5 depicting dispensing of a quantity of talc into a dispensing passage.
Figure 6:
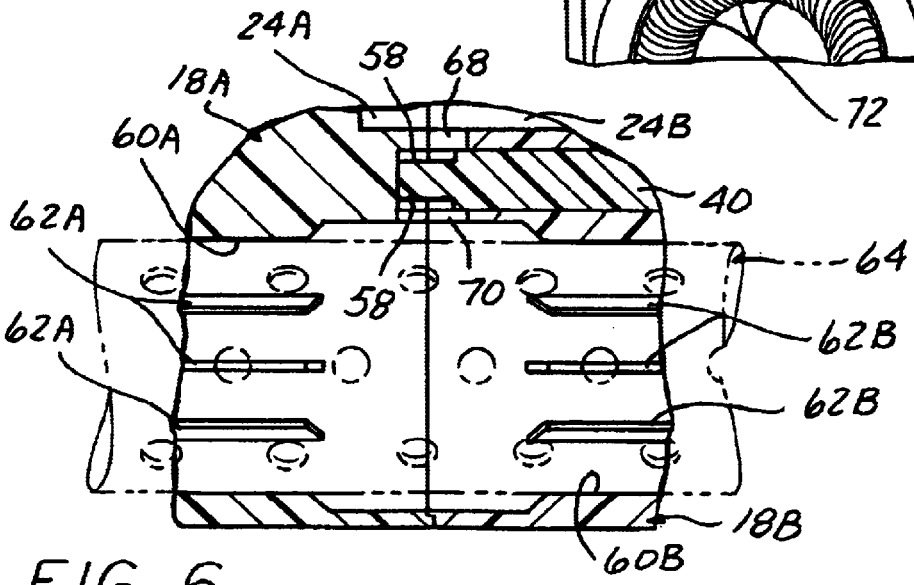
FIG. 6 is a fragmentary sectional view of center portions of the dispenser with a portion of a cue stick shaft shown in phantom lines.

A talc dispenser 10 is shown in FIG. 1 which deposits talc directly onto the shaft a cue stick shaft 12 by contact with bristles having a small quantity of talc dispersed therein when the stick cue shaft 12 is inserted into a tubular through passageway 14 extending completely through a dispenser housing 16, so as to minimize talc spillage. The housing 16 has two mating housing sections 18A, 18B, having mating lip edges 32, 34 (FIG. 4), and are held together with screws 36, covered with a scuff pad insert 38. A holder 20 holds the dispenser 10 when not in use, the holder 20 in turn secured to a user's pocket or belt with a belt clip 22 (best seen in FIG. 2).

A main talc storage cavity 24B is defined in the upper part of the housing section 18B and a shallower cavity 24A in the housing section 18A.

A metering rod 40 is rotatable in a bore 42 formed in an intermediate wall 44 of the housing section 18A with a knurled end 46 protruding out through a small diameter opening 48 in the end of the housing section 18B to be graspable by the thumb and finger of a user.

A slot 56 in the holder 20 accommodates the knurled rod end 46.

An aligned seat 50 in a partition 54 of housing section 18A receives an opposite confined end 52 of the metering rod 40. The metering rod 40 has a pair of diametrically opposite flats 58 on its inside end 52.

The lower part of each housing section 18A, 18B is formed with a passageway 60A, 60B each aligned with the other form an enclosed space within the through passageway 14 extending completely through the housing. A circumferential set of lengthwise ribs 62A, 62B extend around each passageway 60A, 60B, terminating short of the passageway 60A, B at their adjacent ends.

A tube 64 of a rolled up fibrous or bristle sheet material is inserted within the passageways 60A, 60B, the tube 64 having a perforated backing 66 resting on the inner surface of the ribs 62A, 62B. A lip 61A, 61B (not shown) at the outside of each passageways 60A, 60B captures the tube 64 when the housing sections 18A, B are assembled together. An enclosed annular space 67 is thus defined between the backing 66 and the housing structure defining the passageways 60A, B. The inner diameter of the bristle material tube 64 is such as to create rubbing contact with the pool cue shaft 12.

The storage cavities 24A, 24B are in communication with the enclosed space 67 within the passageways 60A, 60B via radial dispensing passages created by cutouts 68, 70 leading to the bore 42 in which the metering rod 40 is disposed.

As each flat 58 is selectively rotated beneath cutouts 68, a small quantity of talc moves into the small space above the flat 58, and is captured above the flat 58 and upon continued rotation is carried around to the cutout 70 into which it is dumped to pass out into the enclosed space 67 within the passages 60A, 60B.

The ribs 62A, 62B are shorter on one end to terminate short of the cutouts 70 so that the talc can pass around the tube 64 and exit through the perforations in the mat backing 66 and into the bristles or fibers 72 woven into the mat backing 66.

Distribution of talc down the enclosed space 67 is aided by side-to-side shaking of the dispenser 10.

It has been found the small amounts of talc distributed into the bristles via the mat backing perforations will neatly be deposited onto a cue stick shaft inserted into the opening 60A, 60B of the dispenser 10 by rubbing contact with the bristles or fibers.

A chalk block holder 73, for a chalk block 76 is fitted into a square recess 74 in the top of the housing section 18A to be slidably removable, cutouts 78 allowing easy grasping thereof with the fingers.

The complete talc dispenser fits into the holder 22 which closes off the tubular passageways 60A, B when the dispenser 10 is not in use to prevent the escape of residual talc. The holder is configured with cutouts 82 (FIG. 1) which allow removal of the plug 28 for adding talc to storage cavities 24A, B in the dispenser 10. When the plug 28 is rotated in either direction, flanges 29 on the hole 26 and plug 28 engage to lock the plug 28 in place, or disengage to allow removal thereof seal 30 prevents escape of any tale.

We claim:

1. A talc dispenser for a cue stick comprising:

a hollow housing having a talc storing cavity defined therein, a capped port in said housing allowing filling of said cavity with talc;

a tubular through passageway extending through said housing, said tubular passageway being configured to slidably admit the shaft of a cue stick;

a selectively movable metering element controlling movement of talc from said storage cavity into said tubular passageway to thereby distribute talc onto a cue stick shaft inserted therein.

2. The talc dispenser according to claim 1 wherein said tubular passageway enclosed space is lined with bristles to distribute said talc onto a cue stick shaft inserted into said tubular passageway by rubbing contact therewith.

3. The talc dispenser according to claim 1 wherein said tubular passageway enclosed space is lined with a tube formed of a rolled up mat of bristle material to distribute talc onto a cue stick inserted into said tubular passageway by rubbing contact therewith.

4. The talc dispenser according to claim 3 further including an array of perforations formed into a backing of said mat.

5. The talc dispenser according to claim 1 wherein said housing further has a recess receiving a chalk block holder, and a chalk block disposed in said holder, said chalk block holder removable from said housing by pulling the same by grasping portions exposed when said chalk block holder is in said recess.

6. The talc dispenser according to claim 5 further including a scuff pad on said housing.

7. The talc dispenser according to claim 1 further including a housing holder into which said housing can be inserted, said holder covering openings on either side of said housing into said tubular through passageway.

8. The talc dispenser according to claim 1 wherein said metering element comprises a rotatable rod interposed between said storage cavity and said through passageway, said rod having a graspable end protruding from said housing to enable selective rotation thereof; an internal passageway in said housing extending from said storage cavity to said through passageway, said rod extending across said internal passageway and having one or more features capturing a quantity of talc from a storage cavity when rotated past a section of said internal passageway extending to said storage cavity and carrying the same to another section of said internal passageway connected to said through passageway by continued rotation of said metering rod, and depositing said quantity of talc thereinto.

9. The talc dispenser according to claim 1 wherein said housing is formed of two housing sections fixed together, each housing section having a lower portion formed with a section of said through passageway.

10. The talc dispenser according to claim 9 wherein a rolled up piece of fibrous mat material forming a tube is disposed in said tubular passageway, said mat material having a perforated backing and said metering element deposit talc onto said backing.

11. The talc dispenser according to claim 10 wherein said tube is captured by a lip on the outside of each through passageway section.

12. The talc dispenser according to claim 10 wherein a series of lengthwise ribs in each through passageway section hold said tube spaced away from said housing sections defining said through passageway sections to form an annular enclosed space between said backing and said housing defining said through passageway, said enclosed space receiving talc deposited therein by said metering element.

13. The talc dispenser according to claim 10 wherein said holder has a belt clip affixed thereon.

* * * * *